US012203342B2

(12) United States Patent
Dearborn et al.

(10) Patent No.: US 12,203,342 B2
(45) Date of Patent: Jan. 21, 2025

(54) WASH TOOL APPARATUS AND METHOD OF USING THE SAME

(71) Applicants: TD Tools, Inc., Woodburn, KY (US); Accu-Line Wireline Services, LLC, Broussard, LA (US)

(72) Inventors: Earl H. Dearborn, Lafayette, LA (US); Thomas L. Dotson, Woodburn, KY (US); Stanley Evans, Broussard, LA (US); John M. Piercy, Bowling Green, KY (US)

(73) Assignees: TD Tools, Inc., Woodburn, KY (US); Accu-Line Wireline Services, LLC, Broussard, LA (US)

( * ) Notice: Subject to any disclaimer, the term of this patent is extended or adjusted under 35 U.S.C. 154(b) by 0 days.

(21) Appl. No.: 18/475,410

(22) Filed: Sep. 27, 2023

(65) Prior Publication Data

US 2024/0102361 A1 Mar. 28, 2024

Related U.S. Application Data

(60) Provisional application No. 63/377,397, filed on Sep. 28, 2022.

(51) Int. Cl.
*E21B 37/00* (2006.01)
*E21B 34/14* (2006.01)

(52) U.S. Cl.
CPC ..... *E21B 37/00* (2013.01); *E21B 34/14* (2013.01); *E21B 2200/05* (2020.05)

(58) Field of Classification Search
CPC ..... E21B 37/00; E21B 34/14; E21B 2200/05
See application file for complete search history.

(56) References Cited

U.S. PATENT DOCUMENTS

| | | | | |
|---|---|---|---|---|
| 2,382,685 | A * | 8/1945 | Washburn | E21B 37/00 166/104 |
| 2,626,829 | A * | 1/1953 | Maxwell | E21B 37/00 294/86.11 |
| 3,627,046 | A | 12/1971 | Miller et al. | |
| 2008/0308269 | A1 | 12/2008 | D'Amico | |
| 2015/0308232 | A1 | 10/2015 | Hallundbaek | |
| 2017/0030156 | A1 | 2/2017 | Churchill | |

FOREIGN PATENT DOCUMENTS

WO WO 2021/170299 9/2021

OTHER PUBLICATIONS

International Search Report and Written Opinion issued in corresponding PCT Application No. PCT/US2023/075204, issued Jan. 3, 2024.

* cited by examiner

*Primary Examiner* — Dany E Akakpo
(74) *Attorney, Agent, or Firm* — NORTON ROSE FULBRIGHT US LLP

(57) ABSTRACT

The present disclosure includes a cleaning system for cleaning clean a tubing, casing, or components of an oil well. In some aspects the cleaning system includes a washing tool having a body configured for insertion into a component of an oil well. The body may include a proximal end and a distal end and define an inlet at the proximal end, a channel in fluid communication with the inlet, and an outlet in fluid communication with the channel. The outlet my extend circumferentially along a perimeter of the body. In some configurations, the washing tool may be configured to clean the component by ejecting fluid in a 360 degree range without movement of the tool.

21 Claims, 8 Drawing Sheets

WASH TOOL APPARATUS AND METHOD OF USING THE SAME

PRIORITY

This application claims the benefit of U.S. Provisional application 63/377,397 filed Sep. 28, 2022. This application claims priority to and incorporates herein by reference the above-referenced application in its entirety.

FIELD OF INVENTION

The present invention relates generally to a wash tool for removing deposits or other debris from a tubing, casing, or components, and more specifically, to a washing tool for cleaning a surface controlled subsurface safety valve in a tubing, or casing, or components of an oil and gas well.

BACKGROUND

The accumulation of scale and deposits such as asphaltene, calcium carbonate, barium sulfate and other debris inside well completion components has long been a problem that prevents the components from operating properly and thereby failing pressure tests. These components, for example a surface controlled subsurface safety valve "SCSSV", may have sealing surfaces and moving parts in the inner circumference of the tool that are difficult to access with traditional cleaning methods. Conventional tools cannot reach certain components and often include motorized components that are susceptible to failure.

SUMMARY

The present disclosure is related to a cleaning system that can effectively clean hard to reach well completion components. The present washing tool may eject fluid to clean an internal diameter of a pipe despite changing pipe size through a length of the well components. Such cleaning is not possible with conventional mechanical devices, which can clean material that can be contacted by the rotating mill, but cannot extend out beyond its maximum diameter to clean larger sections of pipe. The present washing tool can also manipulate one or more components (e.g., valves) while fluid is ejected to spray the fluid in hard-to-reach areas. Current water jets are unable to push, open, or retain components while also ejecting fluid. In some embodiments, the fluid ejection spans a majority of the circumference of the tool up to a 360 degree range. This reduces or eliminates the need to rotate the tool to clean an entirety of the circumference of the pipe and may be able to operate without a coiled tubing unit.

In some aspects of the present disclosure, the washing tool may include a body configured for insertion into a component of an oil well. The body may have a proximal end and a distal end and, in some configurations, the body defines: an inlet at the proximal end, a channel in fluid communication with the inlet, and an outlet in fluid communication with the channel and extending circumferentially along a perimeter of the body. In some configurations, the outlet may extend along a majority of the perimeter of the body. For example, the outlet can extend along an entirety of the circumference of the body. In some configurations, a width of the outlet, measured longitudinally along the body, is adjustable. In some aspects, the body is configured to eject fluid without movement of the body, such as without rotation or translation.

In some of the disclosed configurations, the component may be a production string. In such configurations, the body may be configured to be coupled to the production string such that fluid pumped into the production string is ejected from the outlet. The body may include a first segment and a second segment that are moveable relative to each other to adjust a width of the outlet. The first segment may include the proximal end and define the inlet of the channel. The second segment may be releasably coupled to the first segment and includes the distal end.

In some aspects, while the first and second segments are coupled together, the first segment and the second segment cooperate to define the outlet. In some configurations, the channel includes a first portion extending from the inlet toward the distal end and a second portion in fluid communication with the first portion of the channel and the outlet. The first and second segment may cooperate to define at least a part of the second portion. The first segment may include a first end and a second end and the second segment may include a first end and a second end. In some such configurations, the first end of the second segment is configured to be coupled to the second end of the first segment.

In some of the described configurations, the first end of the second segment may define a chamber that is configured to receive the second end of the first segment. In some such configurations, the chamber may include a threaded connection configured to engage with a threaded connection of the first segment to couple the first and second segments together. In some configurations, the first segment may define a first passage extending longitudinally along the body and a plurality of second passages extending radially from the first passage. In some such configurations, while the first and second segments are coupled together, the second passages are disposed within the chamber. The fluid introduced into second passages may travel through the chamber and out of the outlet.

In some aspects, the tool may include a shim disposed within the chamber between a seat of the chamber and the second end of the first segment. The shim(s) may have a collective length having a first dimension that is substantially equal to a width of the outlet. In some configurations, the first segment includes a first portion having a first maximum transverse dimension and a second portion having a second maximum transverse dimension that is less than the first maximum transverse dimension. The second portion may be closer to the second end of the first segment than is the first portion. In some configurations, the first segment includes a first shoulder that extends between the first portion and the second portion of the first segment. The second segment may include a second shoulder at the first end of the second segment. In some such configurations, while the first and second segments are coupled together, the first shoulder and the second shoulder may cooperate to define the outlet.

Some aspects of the disclosure include a bottom hole assembly tool. The tool may include a first sub configured to be guided along a well casing via a cable and a washing tool coupled to and in fluid communication with the first sub. The washing tool may include a body having a proximal end and a distal end. The body may define an inlet at the proximal end that is configured to receive a fluid, a channel extending from the inlet toward the distal end, and an outlet in fluid communication with the channel, the outlet extending circumferentially along a perimeter of the body and configured to discharge fluid from the washing tool. In some configurations, the first sub includes a sub inlet and a locking mandrel configured to provide a seal between the first sub and a production string of an oil well such that fluid pumped down the production string enters the sub inlet, travels through the channel, and out of the outlet of the body. They tool may include an equalizing sub configured to equalize a pressure between the first sub, the washing tool, and the well casing.

In some aspects, the tool may include a second sub and the washing tool may be disposed between the first sub and the second sub. One or more spacers may be positioned between the washing tool and the first sub, the second sub, or both. In some configurations, while the bottom hole assembly tool is positioned within a component having a subsurface safety valve that includes a flapper and a valve seat, the second sub is configured to hold the flapper in an open configuration while fluid is ejected from the outlet toward the valve seat. In some aspects, a portion of the channel adjacent to the outlet is angled toward the proximal end such that fluid exiting the outlet flows in a direction away from the second sub.

Some aspects of the disclosure include a method of cleaning a component of an oil well. Some of the methods may include inserting a bottom hole assembly tool into a component of an oil well and ejecting a fluid from an elongated slit of the tool at an angle toward an upstream side of the tool. The elongated slit extends circumferentially along a perimeter of a body of the tool and, in some configurations, the tool is stationary while the fluid is ejected from the elongated slit. In some configurations, the component includes a subsurface safety valve having: a valve seat defining an opening and a flapper positioned on a downstream side of the valve seat, the flapper moveable between an open position and a closed position in which the flapper covers the opening. In some such configurations, the method includes opening the flapper and advancing the tool through the opening in a first direction and holding, via the tool, the flapper in the open position. Advancing the tool may include advancing the tool via a slickline.

In some configurations, the method may include locking the tool in place via a locking mandrel. Some methods include sealing the tool in the component such that fluid traveling down the component enters an inlet of the tool. In configurations in which the component is a production string, the method may include introducing the fluid into the production string. In some methods, the fluid is ejected from the elongated slit at a pressure of at least 2,000 pressure per square inch (psi). In some configurations, opening the flapper includes advancing a control sleeve of the subsurface safety valve toward the flapper to move the flapper from the closed position to the open position. In some methods, after advancing the tool through the opening, the control sleeve can be retracted such that the flapper is held in the open position via a bottom sub of the tool.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" or "approximately" is defined as largely but not necessarily wholly what is specified (and includes what is specified; e.g., substantially 90 degrees includes 90 degrees and substantially parallel includes parallel), as understood by a person of ordinary skill in the art. In any disclosed configuration, the term "substantially" may be substituted with "within [a percentage] of" what is specified, where the percentage includes 0.1, 1, 5, and 10 percent.

Further, an apparatus or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), and "include" (and any form of include, such as "includes" and "including") are open-ended linking verbs. As a result, an apparatus that "comprises," "has," or "includes" one or more elements possesses those one or more elements, but is not limited to possessing only those elements. Likewise, a method that "comprises," "has," or "includes" one or more steps possesses those one or more steps, but is not limited to possessing only those one or more steps. As used herein, "or" is inclusive and not exclusive, unless expressly indicated otherwise or indicated otherwise by context, and can have the same meaning as "and/or."

Any configuration of any of the apparatuses, systems, and methods can consist of or consist essentially of—rather than comprise/include/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one configuration may be applied to other configurations, even though not described or illustrated, unless expressly prohibited by this disclosure or the nature of the configurations.

Some details associated with the configurations described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the configuration depicted in the figures.

DETAILED DESCRIPTION

Figure 1:
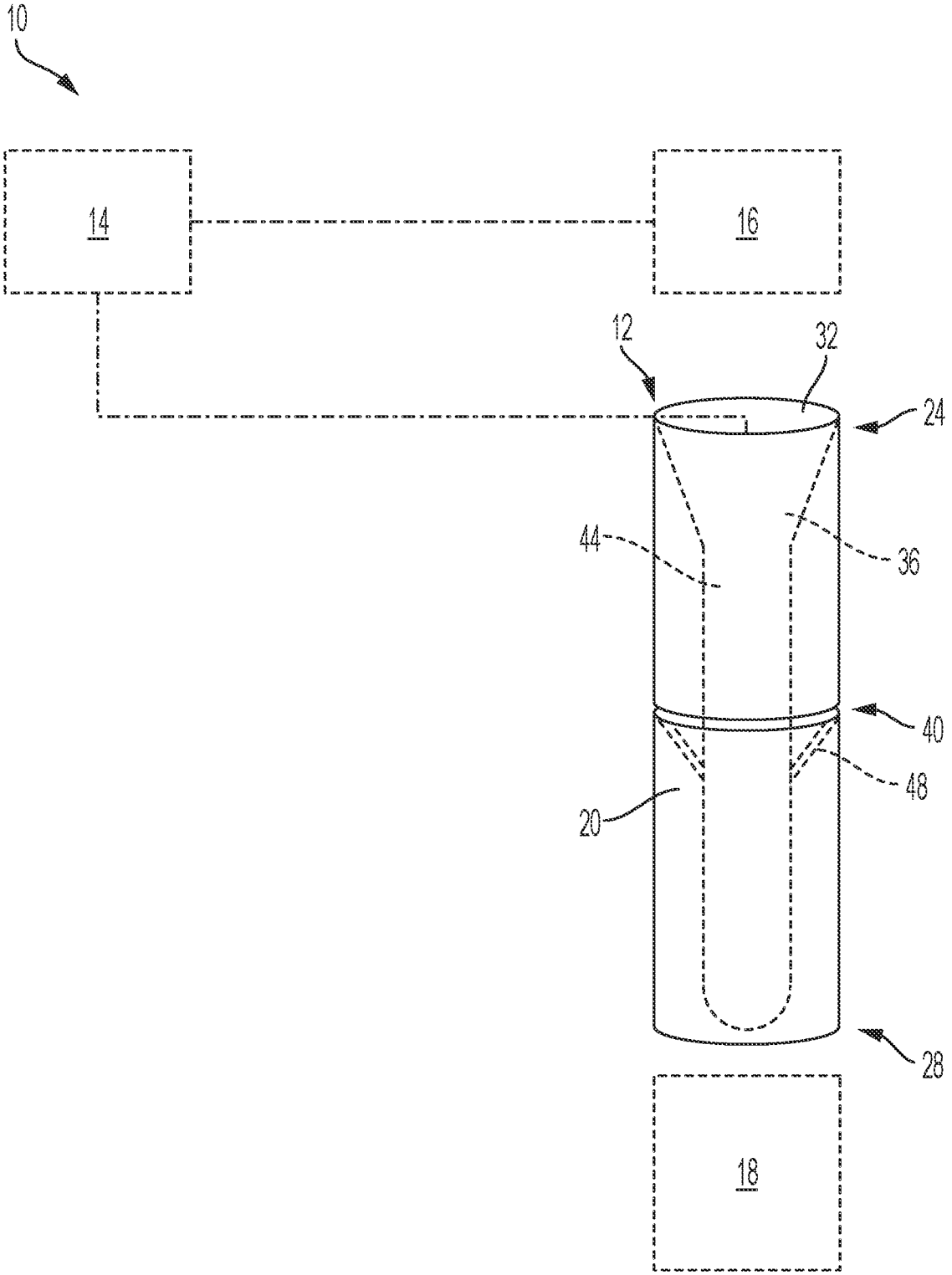
FIG. 1 is a schematic view of an example of a cleaning system of some embodiments of the present disclosure.

Referring to FIG. 1, a washing system 10 (e.g., bottom hole assembly) is shown that is configured to remove deposits or other debris from tubing, casing, or components, such as a tubing, or casing, or components of an oil and gas well. System 10 includes a washing tool 12 (e.g., tool) configured to eject fluid for cleaning components positioned along an interior of a tubing, casing, or components. In some configurations, system 10 may, but need not, include a fluid source 14, first sub 16, a second sub 18, or combination thereof. First and second sub 16, 18 may include or correspond to any suitable tool or component configured to be coupled to a tubing string or cable that is introduced into the wellbore, as explained in more detail in FIGS. 7 and 8. Referring to FIG. 1, washing tool 12 may be positioned between first sub 16 and second sub 18. In some configurations, tool 12 may be in fluid communication with first sub 16, second sub 18, or both. For example, tool 12 may receive fluid from first sub 16 or, alternatively, the tool may receive fluid directly from fluid source 14.

Tool 12 includes a body 20 having a proximal end 24 and a distal end 28. Body 20 may be configured for insertion into a tubing, or casing, or components of an oil well. For example, proximal end 24 of body 20 may be configured to be coupled to a cable (e.g., slickline, wireline, sandline, wire, or the like) to move the body along the production string. The cable may be coupled to body 20 via first sub 16. As shown, proximal end 24 may be nearer a surface of the wellsite than distal end 28 while body 20 is positioned within the production string. However, in other configurations the tool may be reversed such that end 28 is coupled to first sub. At proximal end 24, body 20 defines an inlet 32 configured to receive a fluid and a channel 36 configured to convey fluid from the inlet through the body. Body 20 defines an outlet 40 in fluid communication with channel 36 and inlet 32 and configured to discharge at least a portion of liquid received at the inlet.

Body 20 may include or correspond to a cylindrical member, however, in other configurations, the body may have a different geometry (e.g., rectangular, polygonal, elliptical, or otherwise curved). Body 20 comprises any suitably rigid material that can withstand pressurized fluid (e.g., up to 3,000 pressure per square inch (psi)), including but not limited to, a metal (e.g., steels, titanium alloys, corrosion resistant alloys, or the like), a polymer, a composite material, and/or the like.

In some configurations, channel 36 includes a first portion 44 extending from inlet 32 toward distal end 28, a second portion 48 extending away from the first portion. Second portion 48 may extend away from first portion 44 at an angle. For example, at least a part of second portion 48 may be angled back towards proximal end 24 such that fluid exiting outlet 40 flows in a direction toward the proximal end. In some configurations, second portion 48 may include a single channel or multiple channels in fluid communication with outlet 40.

Outlet 40 may include an elongated slit extending circumferentially along a perimeter of the body. Outlet 40 is configured to eject fluid in a 360 degree range around body 20 without rotation of the body. For example, as shown in FIG. 1, outlet 40 may extend along an entirety of the perimeter of body 20. In other configurations, outlet 40 may include a plurality of apertures spaced along the perimeter of body 20 to eject fluid in a 360 degree range around the body. To illustrate, a collective length of the apertures, measured circumferentially along body 20, may be at least 50% of a length of the perimeter (e.g., circumference) of the body (e.g., 55, 60, 65, 70, 75, 80, 85, 90, 95, 98% of the circumference). In some aspects, outlet 40 may be elongated such that a length of the outlet (e.g., total length of aperture(s)) is greater that a width of the outlet. In some such configurations, the length of the aperture(s) of outlet 40—measured circumferentially along body 20—is at least 1.5 times the width of the outlet—measured longitudinally along the body— such as, for example, at least 5 10, 15, 25, 50, 75, 100, 125, 150, 200, or 250 times the width. In an illustrative, non-limiting example, a width of outlet 40 may be approximately 0.008 inches and a circumference of the body may be approximately 5.7 inches. In some configurations, outlet 40 may be configured to eject fluid at a pressure of at least 2,000 psi (e.g., 3,000 psi) while coupled to fluid source 14 operating at a flow rate of 7 gallons per minute (gpm). As described further herein, the width of outlet 40 may be adjustable to change the flow properties of fluid exiting the outlet based on the particular demands of the cleaning operation.

Figure 2:
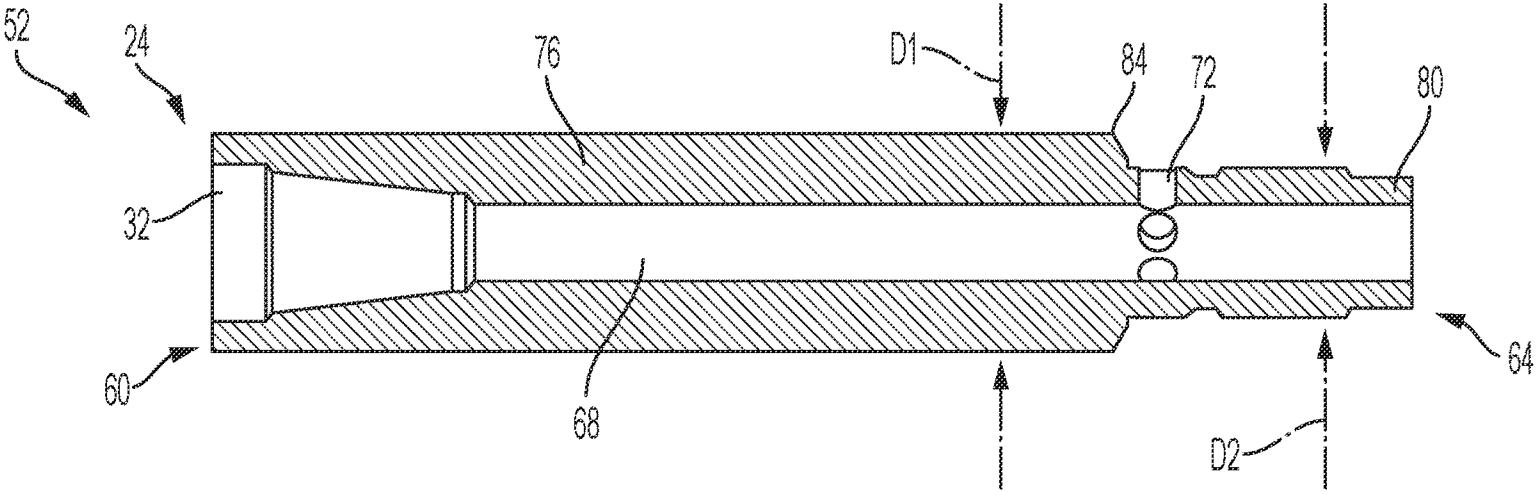
FIG. 2 is a sectional view of a first component of a washing tool of some embodiments of the present disclosure.
Figure 3:
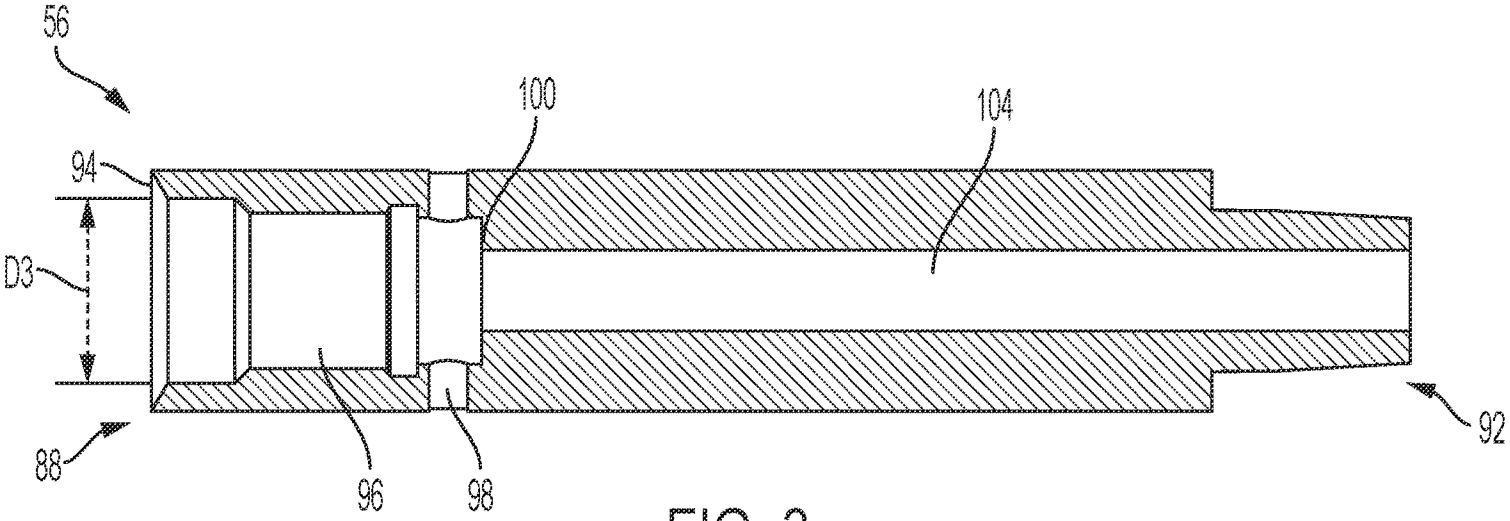
FIG. 3 is a sectional view of a second component of a washing tool of some embodiments of the present disclosure.
Figure 4A:
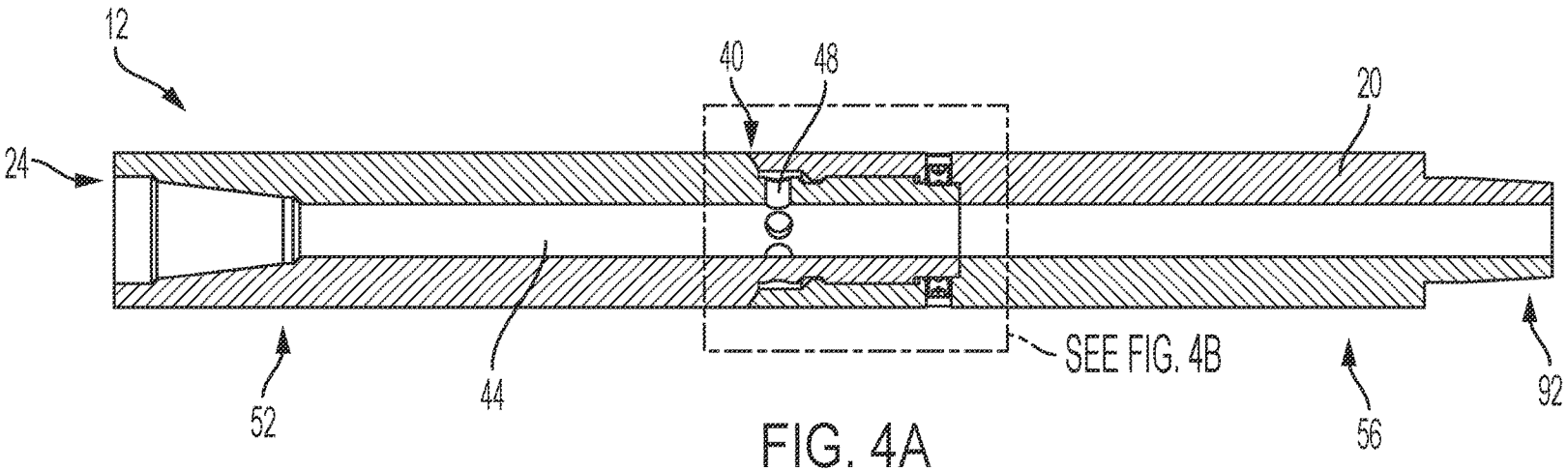
FIG. 4A is a sectional view of a second component of the washing tool with the first component of FIG. 2 and the second component of FIG. 3 coupled together according to some embodiments.

Referring now to FIGS. 2-4, body 20 is shown as a multi-piece assembly. Specifically, FIG. 2 illustrates a cross-section of a first segment 52 of body 20 and FIG. 3 illustrates a cross-section of a second segment 56 of the body that is configured to be releasably coupled to the first segment. As shown in FIG. 4A, first and second segments 52, 56 may be coupled together to define first portion 44 of channel 36, second portion 48 of the channel, outlet 40, or combination thereof.

Referring to FIG. 2, first segment 52 includes a first end 60 and a second end 64 that is opposite the first end. First end 60 may correspond to proximal end 24 of body 20 and define inlet 32 and second end 64 may be configured to be releasably coupled to second segment 56 of body 20. First segment 52 may define one or more passages that make up channel 36. For example, first segment 52 may define a first passage 68 extending between first end 60 and second end 64. First passage 68 is shown extending though first and second ends 60, 64 so that fluid may flow through first segment 52 via the first passage. In some configurations, first passage 68 may include a tapered portion (e.g., nozzle) at first end 60. In some such configurations, the tapered portion may be a convergent frustoconical portion that is configured to increase a velocity of a fluid travelling through first passage 68.

First segment 52 may include a plurality of second passages 72 extending from and in fluid communication with first passage 68 to deliver fluid from the first passage to an exterior of first segment 52. Second passages 72 may extend around (e.g., radially from) first passage 68 to deliver fluid from the first passage in multiple directions. For example, first segment 52 may include at least four or more second passages 72, such as five, six, seven, eight or more passages, extending from first passage 68 so that fluid can be delivered to all sides of the first segment. In other configurations, second passages 72 may include a single passage that surrounds first passage 68 to deliver fluid to each side of first segment 52. Although, FIG. 2 depicts second passages 72 as extending orthogonally to first passage 68, other configurations may include second passages that are acutely or obliquely angled relative to the first passage. For example, second passages 72 may be angles to create a swirling effect in the liquid (e.g., at or near outlet).

In some configurations, each second passage 72 may include an internal diameter that is less than an internal diameter of first passage 68. In some configuration, a maximum transverse dimension of first passage 68 may be at least 1.5 times a maximum transverse dimension of second passage(s) 72, such at 1.75, 2.0, 2.25, 2.5, or 3.0 times greater. In an illustrative, non-limiting example, second passage 72 may have a transverse dimension that is about ¼ inch (e.g., substantially between ⅛ and ½ inch) and first passage may have a transverse dimension that is substantially 1 inch (e.g., substantially between ½ an 1¼ inch). However, in other configurations the sizing may be adjusted to minimize pressure loss through the second passages and to provide uniform fluid spray through outlet 40.

First segment 52 may have outer dimension (e.g., diameter) that varies along its length from first end 60 to second end 64. For example, as shown in FIG. 2, first segment 52 may include a first portion 76 having a first maximum transverse dimension D1 and a second portion 80 having a second maximum transverse dimension D2 that is less than the first maximum transverse dimension. As shown, second portion 80 may be closer to 64 second end than is first portion 76. In some configurations, first segment 52 may include a first shoulder 84 (e.g., annular angled portion) that extends between first portion 76 and second portion 80. In some configurations, first shoulder 84 may include or correspond to a tapered portion that connects first and second portions 76, 80 and, in other configurations, the first shoulder may be extend substantially orthogonal to first and second portion. First shoulder 84 extends around at least a majority of (e.g., 60, 75, 80, or 90% of) a length of the first segment 52 and, in the configuration depicted in FIG. 2, the first shoulder extends around an entirety of the perimeter of the first segment.

Referring now to FIG. 3, second segment 56 includes a first end 88 and a second end 92 that is opposite the first end. First end 88 and second end 92 may be configured to couple second segment 56 to one or more other components, as described herein. As shown, at first end 88, second segment 56 includes a second shoulder 94 and defines a chamber 96. Second shoulder 94 may include an annular portion that surrounds chamber 96. Second shoulder 94 may be sloped (e.g., beveled) at an angle that corresponds to an angle of first shoulder 84.

Chamber 96 may be configured to be coupled to first segment 52 (e.g., at second portion 80). Chamber 96 may have a third maximum transverse dimension D3 (e.g., diameter) that is greater than or substantially equal to second maximum transverse dimension D2 of second portion 80 so that the second portion can be received within the chamber. In some such configurations, chamber 96 may be shaped to correspond to the exterior shape of second portion 80. For example, second portion 80 may include a plurality of threads or grooves that are configured to engaged with respective grooves or threads of chamber 96. In some configurations, an opening of chamber 96 may have a larger transverse dimension than a threaded portion of chamber so receive fluid from first segment 52.

As shown in FIG. 3, second segment 56 may include a seat 100 that defines an end portion of chamber 96. Seat 100 may be configured to limit a distance that second portion 80 may advance within chamber 96. Additionally, or alternatively, second segment 56 may define a plurality of apertures 98 extending from chamber 96 to an exterior of the second segment 56. In such configurations, apertures 98 may extend radially away from chamber 96 and may be able to receive a fastener, such as a set screw. In some configurations, chamber 96 includes once or more grooves that are configured to receive a seal (e.g., O-ring). In such configurations, a portion of chamber 96 (e.g., the portion in communication with apertures 98) may be sealed from channel 36 while the first and second segments 52, 56 are coupled together.

In some configurations, second segment 56 may include a third passage 104 extending between first end 88 and second end 92 of second segment. Third passage 104 may extend from seat 100 and be in fluid communication with first passage 68 of first segment 52 while the segments are coupled together. Third passage 104 may extend through second end 92 to convey fluid to one or more downstream components, such as a bottom sub. In such configurations, second end 92 of second segment 56 is configured to couple washing tool 12 to a downstream component in a suitable manner (e.g., via a threaded connection, mating features, pins, or other fasteners). In other configurations, third passage 104 may be excluded from second segment or may terminate before second end 92.

Figure 4B:
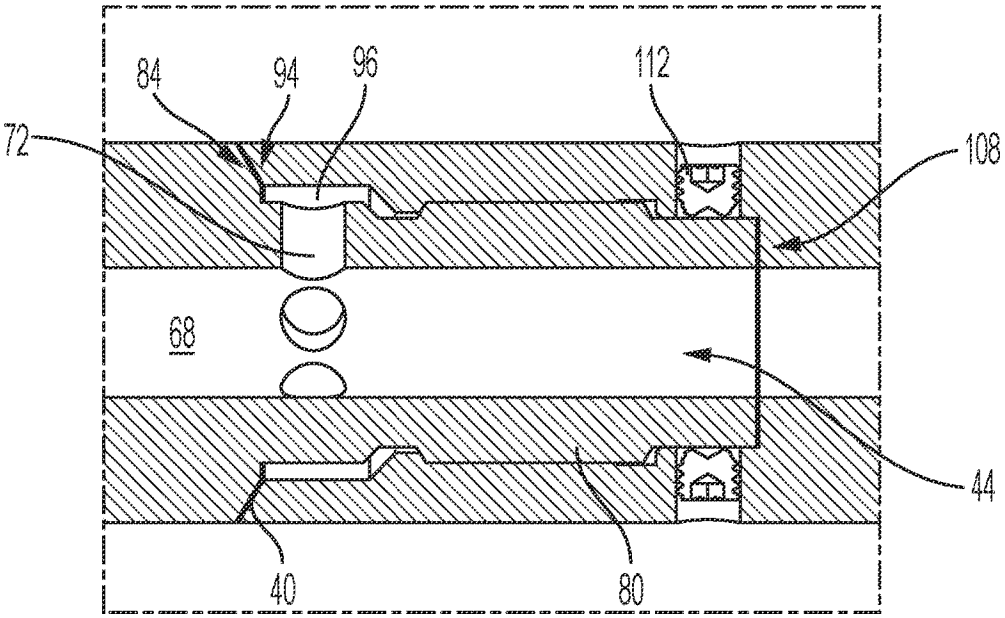
FIG. 4B is an enlarged view of the washing tool of FIG. 4A.

Referring now to FIG. 4A-4B, a sectional view of body 20 is shown with first and second segments 52, 56 coupled together. While coupled together, first segment 52 and second segment 56 cooperate to define at least a portion of channel 36. For example, first passage 68 and third passage 104 may cooperate to define first portion 44 of channel 36. In some configurations, such as that shown in FIG. 4A, first portion 44 of channel 36 extends parallel to a longitudinal axis of body 20. Additionally, or alternatively, second passages 72 and chamber 96 may cooperate to define second portion 48 of channel 36.

Referring to FIG. 4B, first shoulder 84 of first segment 52 and second shoulder 94 of second segment 56 cooperate to define outlet 40. Outlet 40 is depicted as being angled toward proximal end 24 of body 20, however, outlet 40 may otherwise be angled (e.g., orthogonal or angled toward distal end 28). In some configurations, outlet 40 has a length, measured circumferentially, that extends around an entirety of a perimeter of body 20. In such configurations, outlet 40 may eject fluid in a complete 360 degree range without rotation of body 20. To illustrate, fluid inserted into inlet 32 travels through first passage 68, though second passages 72 into chamber 96 and out of outlet 40. Tool 12 may be stationary while the fluid is discharged from outlet 40.

In the depicted configurations, a width of outlet 40 (e.g., distance between first shoulder 84 and second shoulder 94) is adjustable to alter the target flow parameters. As shown, seat 100 may be configured to about second end 64 of first segment 52 while first and second segments 52, 56 are coupled together. In an illustrative configuration, a length of second portion 80 is substantially equal to a length of chamber 96 such that while second end 64 is in contact with seat 100, first shoulder 84 is in contact with second shoulder 94. In this way, while second portion 80 is fully inserted into chamber 96, a width of outlet 40 is negligible (e.g., first and second shoulders 84, 94 are in contact). One or more shims 108 (e.g., planar, annular members) may be positioned within chamber 96 to limit the distance that second portion 80 may extend in chamber 96 so that while second portion 80 is fully inserted into the chamber 96, a width of outlet 40 is large enough for fluid to flow through. In such configurations, a collective length of shims 108 is substantially equal to the width of outlet 40. An operator may select a number or type of shims 108 (e.g., ring shims) to control the width of outlet 40 to adjust fluid ejection properties of tool 12. In an alternative configuration, a length of second portion 80 is greater than a length of chamber 96 such that while second end 64 is in contact with seat 100, first shoulder 84 is spaced from second shoulder 94 by a preset distance. If a target width of outlet 40 is greater than the preset distance, shims 108 may be added to increase the width of outlet 40.

As depicted in FIG. 4B, second passages 72 are positioned within chamber 96 to transfer fluid to the chamber. A maximum transverse dimension (e.g., diameter) of chamber 96 may be greater at an opening so that the opening may be in fluid communication with the second passages 72 while a separate portion of the chamber (e.g., threaded portion) is sealed from the second passages. In some configurations, one or more fasteners 112 may be used to secure second portion 80 of first segment 52 to second segment 56. Each fastener 112 may be configured to extend through apertures 98 to couple the first and second segments together. Fasteners 112 and apertures 98 are sealed from chamber 96 via the threaded connection, one or more seals (e.g., O-rings), or both. In some configurations, shims 108 create a seal with seat 100 and second end 64 of first segment so that fluid does not leak out of apertures 98. For example, shims 108, second end 64, and seat 100 may have the same shape (e.g., flat, annular members) so that they may be stacked together.

Figure 5:
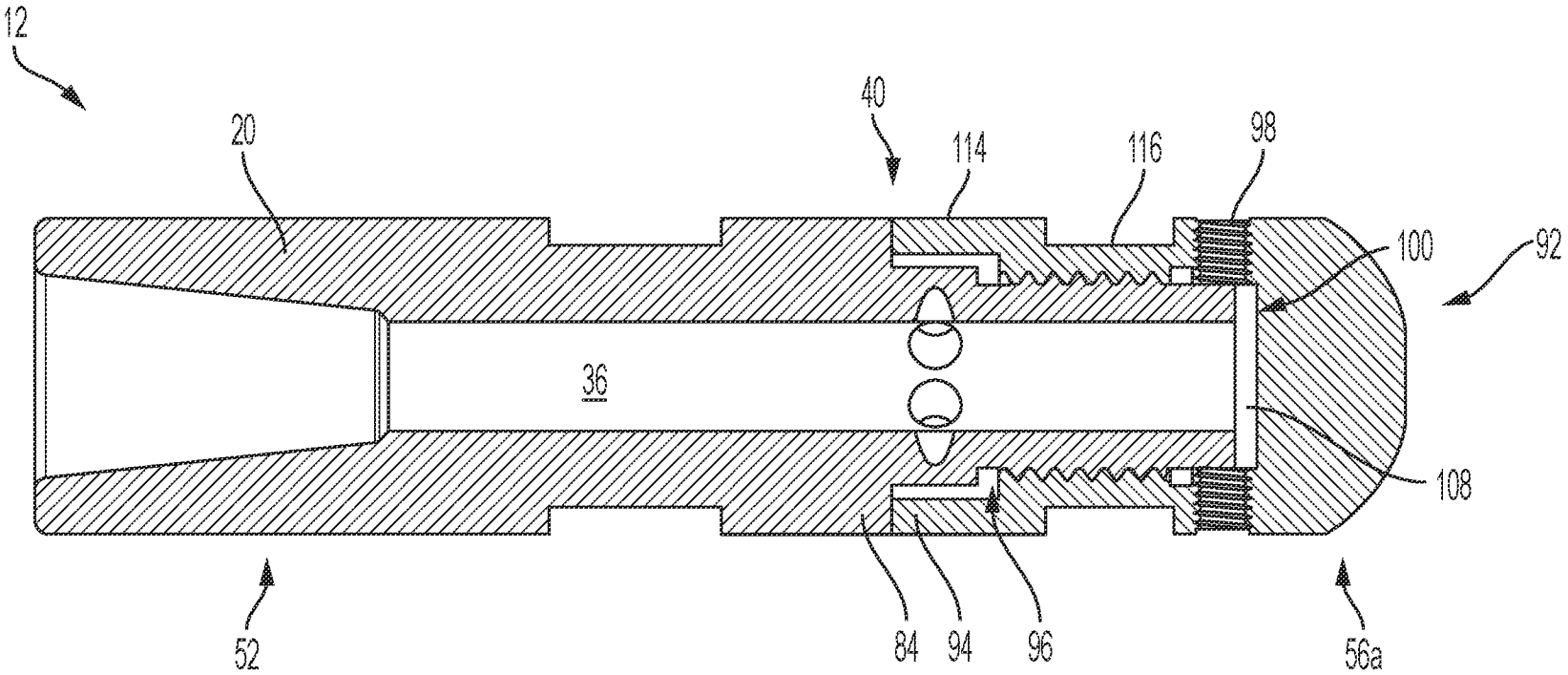
FIG. 5 is a sectional view of another example of a washing tool of some embodiments of the present disclosure.

Referring now to FIG. 5, a second example of tool 12 is shown. In these configurations, components that are similar, such as in structure or function, to components discussed with reference to FIGS. 2-4B are labeled with the same reference numerals and a new numeral suffix, for example "a." In the configuration shown in FIG. 5, tool 12 includes a first segment 52 and a second segment 56*a* that is configured to be releasably coupled to the first segment.

Second segment 56*a* extends from first end 88 to second end 92 and defines chamber 96 extending therebetween. Second segment 56*a* has a length that is smaller than that of second segment 56 and may be utilized in instances that require a shorter tool to reach the area to be cleaned. Second end 92 may be solid and not configured to attach to further downstream components. For example, second end 92 may include or correspond to a snub nose or bull nose at the end of tool 12. Second segment 56*a* includes an outlet portion 114 that includes second shoulder 94 and a threaded portion 116 that includes a male or female threaded connection.

A portion of chamber 96 defined by outlet portion 114 has a greater transverse dimension than a portion of the chamber defined by threaded portion 116. The portion of chamber 96 defined by outlet portion 114 is configured to receive fluid from second passages 72 and transfer the fluid to outlet 40. In some configurations, the portion of chamber 96 defined by threaded portion 116 is configured to provide a seal against fluid entering though second passages 72 to prevent fluid from leaking out of apertures 98. In the depicted configuration, first shoulder 84 and second shoulder 94 extend orthogonally from a perimeter of body 20. Yet, in other configurations, first shoulder 84 and second shoulder 94 of second segment 56*a* may be angled relative to the perimeter of body 20, as described herein. One or more shims 108 may be disposed within body 20 (e.g., in chamber 96) to adjust a width of outlet, as described herein. In the configuration depicted in FIG. 5, shims 108 need not define an aperture for fluid to pass through.

Figure 6:
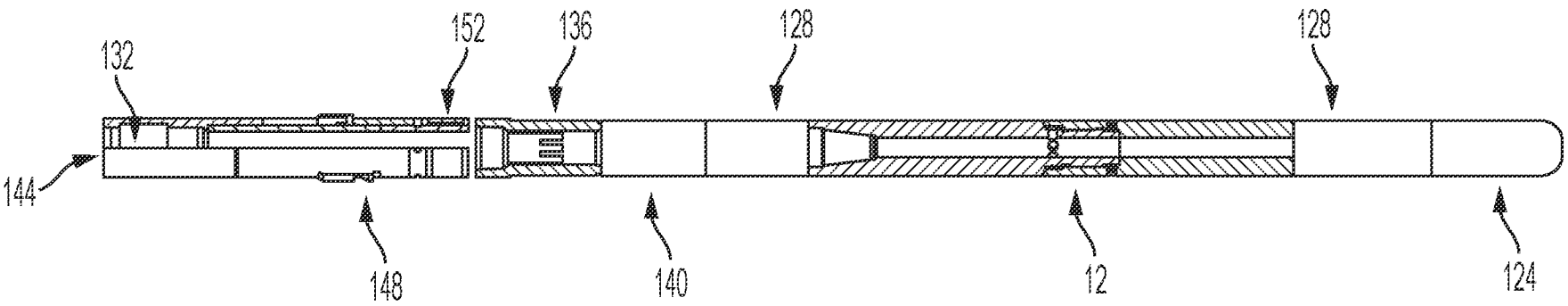
FIG. 6 is a sectional view of another example of the cleaning system of some embodiments of the present disclosure.

Referring now to FIG. 6, system 10 an example of one configuration of system 10 is shown. System 10 may include or correspond to a downhole tool assembly and, in the depicted configuration, includes washing tool 12, a top sub 120, a bottom sub 124, or combination thereof. Tool 12 is in fluid communication with top sub 120 such that at least a portion of fluid received at an inlet of top sub is delivered to inlet 32 of the washing tool. In some configurations, tool 12 may be in fluid communication with bottom sub 124 such that at least a portion of fluid received at inlet 32 is delivered to the bottom sub. In some such configurations, bottom sub 124 may include a knock out plug, or other valve, configured to equalize pressure between system 10 and the production string, as described herein. In configurations including bottom sub 124, tool 12 is positioned between the bottom sub and top sub 120.

In some configurations, such as one or more spacers 128 may be positioned between tool 12 and top sub 120, the tool and bottom sub 124, or both. Spacers 128 are configured to be removably coupled to washing tool 12, top sub 120, or bottom sub 124 and include one or more conduits to allow flow of fluids between the components. In some configurations, spacers 128 may be tubular cylindrical members. Spacers 128 may be utilized to position outlet 40 of tool 12 at a target distance from one or more components of top or bottom sub 120, 124, as described herein.

Top sub 120 may include one or more sub-assemblies and, as depicted in FIG. 6, the top sub 120 may include a locking mandrel 132, an equalizing sub 136, a crossover 140, other sub-assembly, or combination thereof.

Locking mandrel 132 includes a fluid inlet 144 configured to receive a fluid and, in some configurations, may be configured to be, directly or indirectly, coupled to a cable or other retrieval rod to lower and raise the top sub 120 through a well. In some configurations, locking mandrel includes a seat no-go 148 configured to engage a portion of the production tubing. For example, seat no-go 148 may include a shoulder, such as a projection or stepped outer profile, configured to rest on a locking component (e.g., nipple) of the production string. Seat no-go 148 may engage the locking component via gravity or pressure, such as fluid pressure pumped into the production tubing to push the seat no-go against the locking component. In some configurations, seat no-go 148 may be shaped (e.g., beveled, contoured, or the like) to mate with the locking component.

In some configurations, locking mandrel 132 includes one or more seat seals 152 configured to create a seal between the locking mandrel and production string. Seals 152 may be configured to seal the seat no-go 148 against the locking components so that fluid may only flow downstream of locking mandrel 132 via inlet 144. In some configurations, seals 152 are rings (e.g., O-rings) of a malleable material, such as plastic or rubber and may be disposed within a groove defined by locking mandrel 132, such as a groove in seat no-go 148. Additionally, or alternatively, seals 152 may be a sealing jacket, inflatable compression balloon, packer, or plug-type seals.

Equalizing sub 136 is configured to regulate a pressure differential above and below top sub 120. In some configurations, equalizing sub 136 may include one or more valves (e.g., check valves) configured to release fluid from an interior passage of the equalizing sub to the well. In such configurations, equalizing sub 136 is in fluid communication with inlet 144 so that actuation of the value equalizes the pressure on the upstream side and downstream side of seals 152. As an illustrative example, once a seal is created between top sub 120 and the production string, equalizing sub 136 may be actuated to unseal the components. For example, after system 10 is used to clean components of the production string, equalizing sub 136 may be actuated so that the top sub 120 may be brought back to the surface. Some configurations may include a crossover 140 that is configured to connect top sub 120 to one or more other components, such as a spacer 128, tool 12, or the like.

Figure 8:
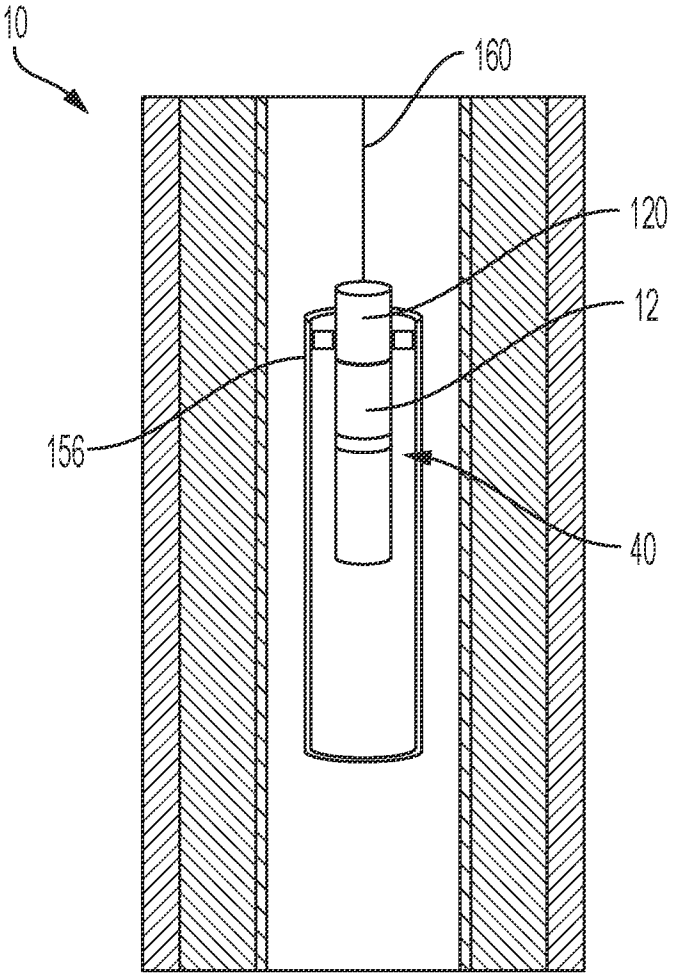
FIGS. 7 and 8 are first and second configurations, respectively, of an embodiment of the cleaning system in use with a tubing, or casing, or components of an oil and gas well.
Figure 7:
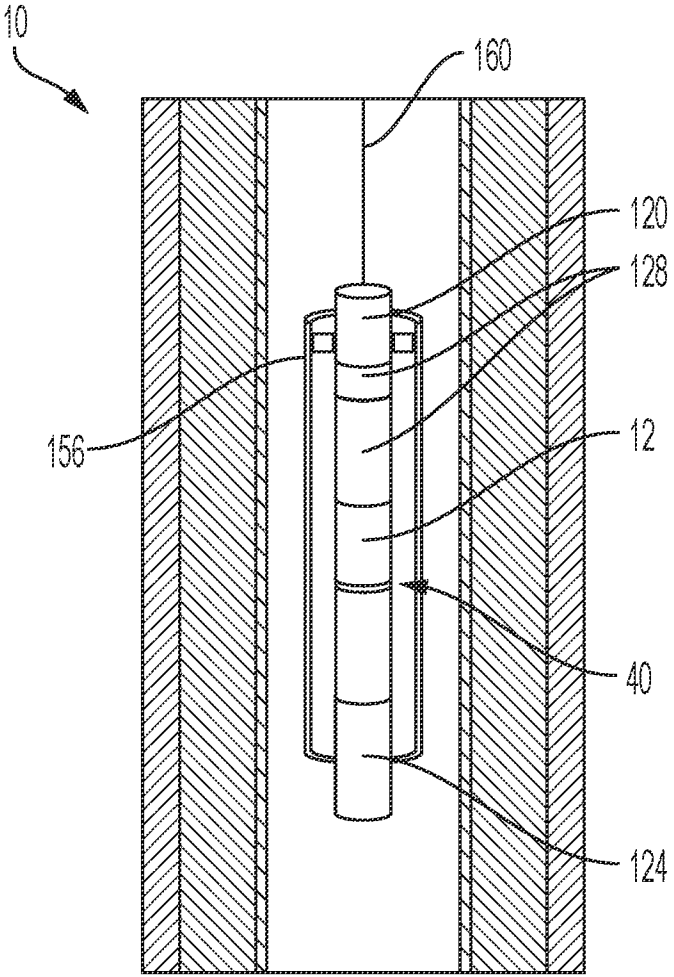

As shown in FIGS. 7 and 8, each of top sub 120, tool 12, and bottom sub 124 may be sized to fit within a tubing, or casing, or components 156 of a well to clean the interior of the components. Top sub 120 may be connected to cable 160, such as a wireline, slickline, or the like, and lowered into a production string, or casing, of a well to guide tool 12 along the well. In some configurations, top sub 120 or tool 12 may be coupled to coiled tubing that can deliver fluid to outlet 40 while the system 10 is moving within the well. However, system 10 may operate without coiled tubing at well sites without a coiled tubing unit, saving time and resources compared to other cleaning devices.

Referring now to FIG. 7, top sub 120 is configured to create a seal with tubing, or casing, or components 156 (e.g., via locking mandrel 132). To illustrate, cable 160 may be configured to lower top sub 120 to a nipple, or other locking feature, in a production string (e.g., 156) and couple the top sub to the string. In such configurations, top sub 120 is fixed relative to string, and cable 160 may be withdrawn. Fluid may then be pumped directly into string to flow into inlet 144 of top sub 120 and out of outlet 40 of tool 12. In this way and others, fluid flow can be easily controlled via a surface pump and no additional equipment or moving components are required during use of system 10.

System 10 may be configured to adjust a position of outlet 40 and fluid properties of the outlet flow based on the particular application. As the dimensions of the tubing, or casing, or components 156 are known, a relative distance between the locking features (e.g., nipple) of the string and a target cleaning area can be calculated. In such configurations, system 10 may be configured such that a distance between top sub 120 and outlet 40 of tool corresponds to the calculated distance to place the outlet adjacent to the target cleaning area. For example, a number or length of spacers 128 may be selected to appropriately position tool 12 relative to the target cleaning area. As shown in FIG. 7, two spacers 128 are positioned between top sub 120 and tool 12. In a different application, shown in FIG. 8, no spacers are disposed between top sub 120 and tool 12. Additionally, or alternatively, bottom sub 124 may be added (FIG. 7) or removed (FIG. 8) based on the particular cleaning application. For example, bottom sub 124 or spacers 128 may be attached downstream of tool 12 to hold open a valve or contact a downstream component.

The fluid properties of the outlet flow can be adjusted by altering a width of outlet 40 and the flow of fluid entering production tubing (e.g., 156). The flow of fluid into the production tubing may be controlled via a surface pump in any suitable manner known in the art. Width of outlet 40 is adjustable via insertion of one or more shims 108 within body 20 of tool. Adjusting the area of outlet 40 can enable tool 12 to work with various on-site pumps. For example, a width of outlet 40 may be set to a smaller value (e.g., 0.1-5 millimeters, such as 0.2 to 1 mm) to increase the velocity of fluid ejected at outlet for use with a smaller pump or the width of the outlet may be set to a larger value (e.g., 10-15 centimeters) if a more powerful pump is available. In some configurations, both pump and tool 12 are configured to produce fluid at a pressure of between 2,000-4,000 psi. In some configurations, tool 12 is able to produce a 3,000 psi, 360° spray with a flow as low as 7 gallons per minute (gpm).

Figure 9C:
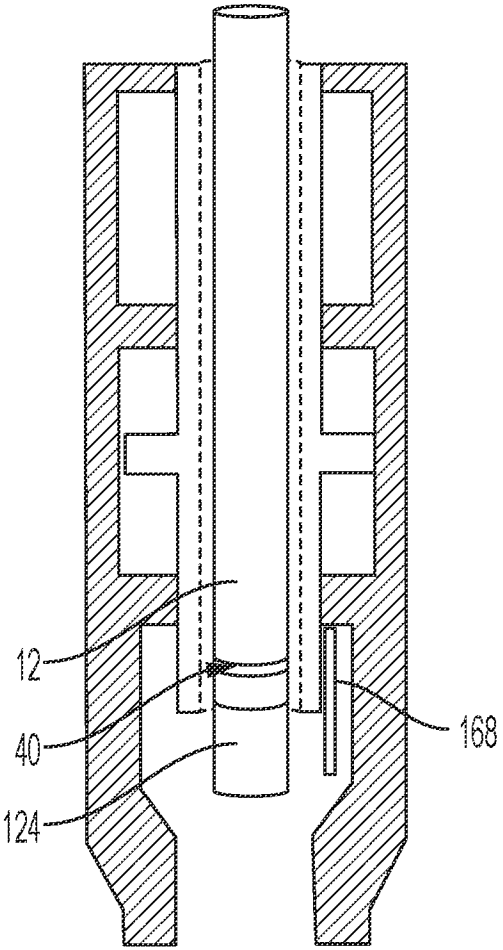
FIGS. 9A-9E is a diagram showing an example of a process of cleaning a subsurface safety valve (SSSV) with an example of the cleaning system of the present disclosure.
Figure 9B:
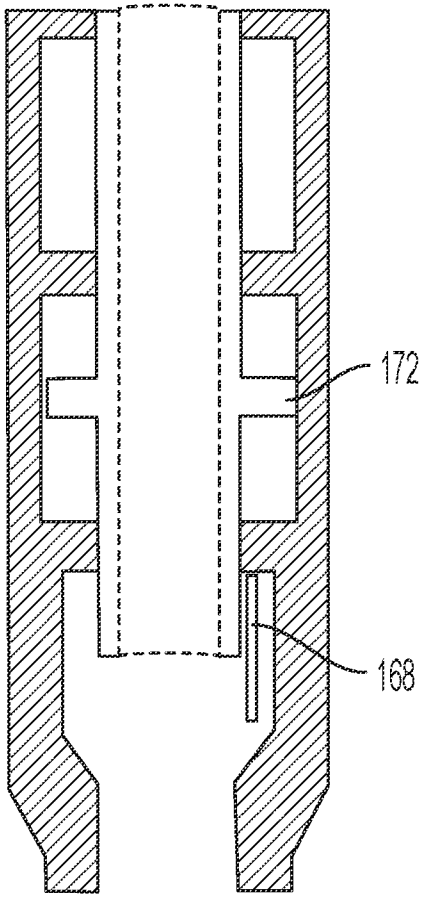
Figure 9A:
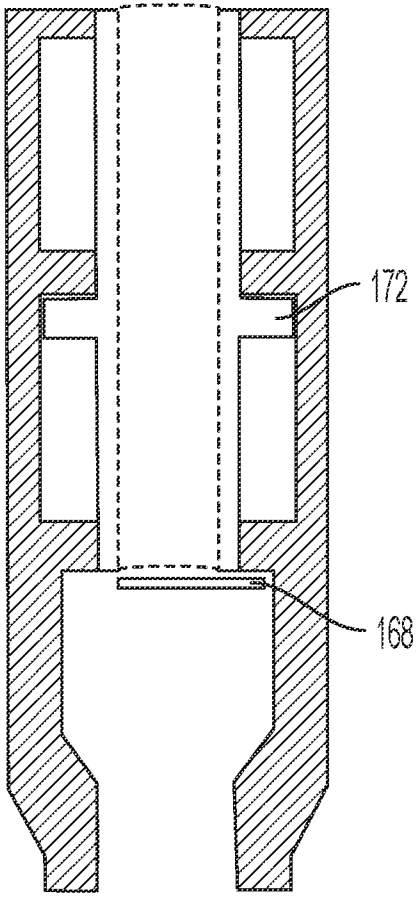
Figure 9E:
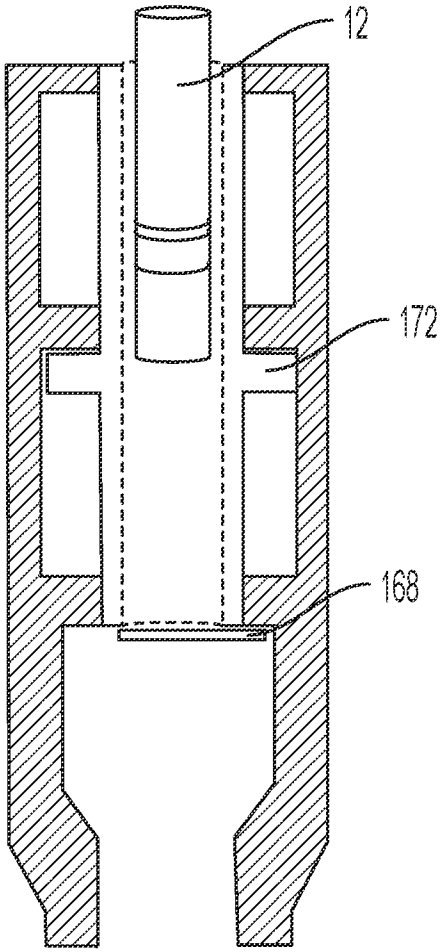

Referring now to FIGS. 9A-9E, a method of using system 10 for cleaning subsurface safety valve (SSSV) is shown. The SSSV includes a flapper 168 and a control sleeve 172 moveable relative to the flapper to move the flapper to an open position. Each of flapper 168 and control sleeve 172 are biased to a closed position, as shown in FIG. 9A, to prevent fluid flow. Referring to FIG. 10B, an external force, such as increased hydraulic pressure in an upper cavity, forces control sleeve 172 downward towards flapper 168 and pushes the flapper to the open position. In the open position, fluid can now flow though the SSSV. However, a large portion of the valve seat and flapper 168 are obstructed by an end of control sleeve 172 and conventional cleaning devices cannot reach the valve seat or covered portions of the flapper.

Referring now to FIG. 9C, system 10 may be inserted within the SSSV and lowered through control sleeve 172 to position outlet 40 of tool 12 adjacent to flapper 168. In some configurations, an operator may select a number or length of spacers (e.g., 128) to adjust a relative position of tool 12 and top sub 120, bottom sub 124, or both. Additionally, or alternatively, a number or length of shims 108 may be selected to adjust a width of outlet 40. In a non-limiting example, a width of outlet 40 may be selected based on a power (e.g., hydraulic horsepower) of a pump. Although not shown, top sub 120 may be fixedly coupled to create a seal upstream of SSSV, as described herein. While outlet 40 is positioned to clean flapper 168, the outlet may be within the control sleeve 172 and bottom sub 124 may extend to an end of, or past, the control sleeve.

Figure 9D:
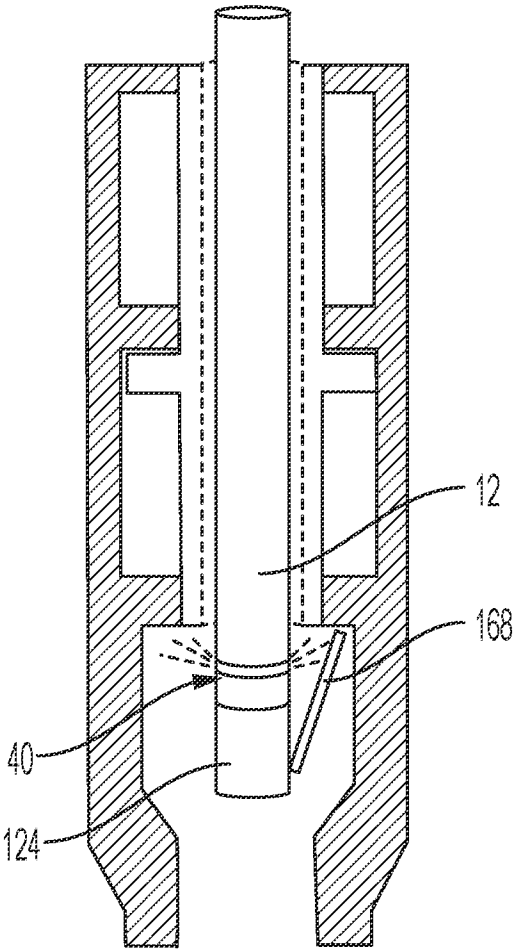

Once system 10 is in position, control sleeve 172 may be released to the closed position. For example, hydraulic fluid in an upper cavity may be drained, decreasing pressure and allowing a biasing member (e.g., spring) push control sleeve 172 to the closed position. As shown in FIG. 9D, flapper 168 moves toward the closed position as control sleeve is retracted. Bottom sub 124 of tool is positioned to hold flapper 168 in the open position as control sleeve 172 is moved to the closed position. As bottom sub 124 is engaged with flapper 168, an interior of the flapper 168 and the valve seat are exposed to outlet 40. Fluid may then be pumped into system 10 and out of outlet 40 at a 360 degree range to clean the SSSV. In some configurations, outlet 40 is angled upward toward valve seat to eject fluid directly on the valve seat. In other configurations, outlet 40 can be angled downward. For example, washing tool 12 can be introduced into the tubing, casing, or component in a first orientation to eject fluid upward or can be introduced into the tubing, casing, or component in a second orientation (e.g., upside down) to eject fluid downward.

Once a target amount of fluid (e.g., 2 barrels of cleaning solution) is pumped out of outlet 40, the pressure between the upstream and downstream sides of system 10 may be equalized and top sub 120 may be uncoupled from the tubing. System 10 may then be retrieved from the wellbore and taken back up to the surface. The system 10 may then be disassembled for compact storage or re-configured for cleaning another component.

As described herein, system 10 provides advantages over other mechanical, brush cleaning devices, particularly those that are motorized and cannot reach beyond its outer diameter to clean contoured portions of tubing. Further, system 10 may be operated without being conveyed by coiled tubing, which is limited to well sites with a coiled tubing unit and costly to rig up. Some embodiments of system 10 may provide additional advantages over fixed jet tools, by providing increased washing coverage with up to a 360 degree spray. Further, the system 10 may be used to hold open a component (e.g., flapper) during cleaning. System 10 provides an efficient, adjustable cleaning device that is capable of producing high pressure (e.g., greater than 2,000 psi) 360 degree spray without moving parts.

The above specification and examples provide a complete description of the structure and use of illustrative configurations. Although certain configurations have been described above with a certain degree of particularity, or with reference to one or more individual configurations, those skilled in the art could make numerous alterations to the disclosed configurations without departing from the scope of this invention. As such, the various illustrative configurations of the methods and systems are not intended to be limited to the particular forms disclosed. Rather, they include all modifications and alternatives falling within the scope of the claims, and configurations other than the one shown may include some or all of the features of the depicted configurations. For example, elements may be omitted or combined as a unitary structure, connections may be substituted, or both. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one configuration or may relate to several configurations. Accordingly, no single implementation described herein should be construed as limiting and implementations of the disclosure may be suitably combined without departing from the teachings of the disclosure.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims. The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A washing tool for cleaning a component of an oil well, the tool comprising:

a body configured for insertion into a component of an oil well, the body having a proximal end and a distal end, the body defining:

an inlet at the proximal end, the inlet configured to receive a fluid;

a channel in fluid communication with the inlet; and an outlet in fluid communication with the channel, the outlet extending circumferentially along a perimeter of the body wherein the body includes:

a first segment that includes the proximal end and defines the inlet of the channel;

a second segment releasably coupled to the first segment, the second segment includes the distal end and defines a chamber that is configured to receive the first segment; and a shim disposed within the chamber between a seat of the chamber and the first segment.

2. The tool of claim 1, wherein:

the outlet extends along an entirety of the perimeter of the body; and a width of the outlet, measured longitudinally along the body, is adjustable.

3. The tool of claim 1, wherein:

the body include the first segment and the second segment that are moveable relative to each other to adjust a width of the outlet; and the outlet is angled toward the proximal end such that fluid exiting the outlet flows in a direction toward the proximal end.

4. The tool of claim 1, wherein the body is configured to eject fluid without rotation of the body.

5. The tool of claim 1, wherein:

while the first and second segments are coupled together, the first segment and the second segment cooperate to define the outlet.

6. The tool of claim 5, wherein:

the channel includes:

a first portion extending from the inlet toward the distal end; and a second portion in fluid communication with the first portion of the channel and the outlet; and the first and second segment cooperate to define at least a part of the second portion.

7. The tool of claim 5, wherein:

the first segment includes a first end and a second end;

the second segment includes a first end and a second end;

the first end of the second segment is configured to be coupled to the second end of the first segment; and the first end of the second segment defines the chamber that is configured to receive the second end of the first segment.

8. The tool of claim 7, wherein the chamber includes a threaded connection configured to engage with a threaded connection of the first segment to couple the first and second segments together.

9. The tool of claim 7, wherein the first segment defines a first passage extending longitudinally along the body and a plurality of second passages extending radially from the first passage.

10. The tool of claim 9, wherein:

while the first and second segments are coupled together, the second passages are disposed within the chamber; and the fluid introduced into the second passages travels through the chamber and out of the outlet.

11. The tool of claim 7, wherein the shim includes a flat, annular member.

12. The tool of claim 7, wherein:

the first segment includes a first portion having a first maximum transverse dimension and a second portion having a second maximum transverse dimension that is less than the first maximum transverse dimension and wherein the second portion is closer to the second end of the first segment than is the first portion; and the first segment includes a first shoulder that extends between the first portion and the second portion of the first segment.

13. The tool of claim 12, wherein:

the second segment includes a second shoulder at the first end of the second segment; and while the first and second segments are coupled together, the first shoulder and the second shoulder cooperate to define the outlet.

14. A bottom hole assembly tool comprising:

a first sub configured to be deployed within a well casing or production tubing via a cable;

a washing tool configured to be removably coupled to and in fluid communication with the first sub, the washing tool comprising:

a body having a proximal end and a distal end, the body defining:

an inlet at the proximal end, the inlet configured to receive a fluid;

a channel extending from the inlet toward the distal end; and an outlet in fluid communication with the channel, the outlet extending circumferentially along a perimeter of the body and configured to discharge fluid from the washing tool;

a second sub configured to be removably coupled to the washing tool, wherein the washing tool disposed between the first sub and the second sub; and wherein, while the bottom hole assembly tool is positioned within a component having a subsurface safety valve that includes a flapper and a valve seat, the second sub is configured to hold the flapper in an open configuration while fluid is ejected from the outlet toward the valve seat.

15. The tool of claim 14, wherein the first sub comprises a sub inlet and a locking mandrel configured to provide a seal between the first sub and a production string of an oil well such that fluid pumped down the production string enters the sub inlet, travels through the channel, and out of the outlet of the body.

16. The tool of claim 14, comprising:

one or more spacers positioned between the washing tool and the first sub, the second sub, or both.

17. The tool of claim 14, comprising:

the second sub, the washing tool disposed between the first sub and the second sub; and one or more spacers positioned between the washing tool and the first sub, the second sub, or both; and wherein a portion of the channel adjacent to the outlet is angled toward the proximal end such that fluid exiting the outlet flows in a direction away from the second sub.

18. A method of cleaning a component of an oil well, the method comprising:

inserting a bottom hole assembly tool into a component of an oil well, the component includes a subsurface safety valve having:

a valve seat defining an opening; and a flapper positioned on a downstream side of the valve seat, the flapper moveable between an open position and a closed position in which the flapper covers the opening; and opening the flapper and advancing the tool through the opening in a first direction; and holding, via the tool, the flapper in the open position ejecting a fluid from an elongated slit of the tool toward the flapper;

wherein:

the elongated slit extends circumferentially along a perimeter of a body of the tool; and the tool is stationary while the fluid is ejected from the elongated slit.

19. The method of claim 18, wherein the flapper is held in the open position by a sub connected to the tool.

20. The method of claim 19, wherein:

opening the flapper includes advancing a control sleeve of the subsurface safety valve toward the flapper to move the flapper from the closed position to the open position; and further comprising, after advancing the tool through the opening, retracting the control sleeve such that the flapper is held in the open position via a bottom sub of the tool.

21. A method of assembling a washing tool, the method comprising:

determining a target width of an outlet of a washing tool; and based on the target width, selecting one or more shims having a collective length that corresponds to the target width; and assembling the washing tool, the washing tool including:

a body defining an inlet, a channel, and the outlet, the body having:

a first segment defining the inlet and a first portion of the channel;

a second segment releasably coupled to the first segment to define the outlet, the second segment defining:

a chamber that is configured to receive the first segment; and a second portion of the channel the one or more shims disposed within the chamber between a seat of the chamber and the first segment.

* * * * *